US010598187B2

(12) United States Patent
Chang et al.

(10) Patent No.: US 10,598,187 B2
(45) Date of Patent: Mar. 24, 2020

(54) HEAT-DISSIPATION FAN WITH CYLINDRICAL FAN BLADES

(71) Applicant: ASIA VITAL COMPONENTS CO., LTD., New Taipei (TW)

(72) Inventors: Bor-Haw Chang, New Taipei (TW); Chung-Shu Wang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 90 days.

(21) Appl. No.: 15/683,740

(22) Filed: Aug. 22, 2017

(65) Prior Publication Data

US 2019/0063453 A1 Feb. 28, 2019

(51) Int. Cl.

| | |
|---|---|
| ***F04D 29/38*** | (2006.01) |
| ***H01R 39/64*** | (2006.01) |
| ***F04D 19/00*** | (2006.01) |
| ***F04D 29/32*** | (2006.01) |
| ***F04D 29/66*** | (2006.01) |
| ***F04D 29/58*** | (2006.01) |
| ***F04D 25/06*** | (2006.01) |
| ***F04D 17/00*** | (2006.01) |
| ***F04D 23/00*** | (2006.01) |

(52) U.S. Cl.

CPC ..... *F04D 29/384* (2013.01); *F04D 17/00* (2013.01); *F04D 19/00* (2013.01); *F04D 19/002* (2013.01); *F04D 23/00* (2013.01); *F04D 25/06* (2013.01); *F04D 25/0606* (2013.01); *F04D 29/327* (2013.01); *F04D 29/5853* (2013.01); *F04D 29/667* (2013.01); *H01R 39/64* (2013.01)

(58) Field of Classification Search

CPC ..... F04D 28/384; F04D 19/002; F04D 25/06; F04D 29/327; F04D 29/5853; F04D 29/667; H01R 39/64; H01R 13/22; H01R 13/24; H01R 13/2464; H01R 13/28; H01R 24/84; H01R 39/643; H01R 13/2485; H01R 13/2492; F05D 2250/231; F05D 2260/70

USPC ..... 416/4

See application file for complete search history.

(56) References Cited

U.S. PATENT DOCUMENTS 2,184,123 A * 12/1939 Mankoff ..... B02C 13/26 241/185.5
2,283,609 A * 5/1942 McDonald ..... F04D 29/462 415/143

(Continued)

FOREIGN PATENT DOCUMENTS

DE 3731902 * 4/1989 ..... F01D 1/18
DE 102006012812 * 9/2007 ..... F04D 29/18

(Continued)

*Primary Examiner* — John M Zaleskas
*Assistant Examiner* — Susan E Scharpf
(74) *Attorney, Agent, or Firm* — Jackson IPG PLLC; Demian K. Jackson

(57) ABSTRACT

A heat-dissipation fan includes a rotary assembly and a plurality of rotary cylinders mounted on an outer surface of the rotary assembly to serve as cylindrical fan blades of the heat-dissipation fan. The rotary assembly includes a plurality of first electrical conducting units and a second electrical conducting unit. The rotary cylinders move along with the rotary assembly when the latter rotates and are correspondingly electrically connected to the first electrical conducting units to be rotatable about their respective centerlines.

15 Claims, 16 Drawing Sheets

(56) References Cited

U.S. PATENT DOCUMENTS 2,538,797 A * 1/1951 Oetzel ..... H02K 49/043 310/93
4,366,386 A * 12/1982 Hanson ..... F03D 1/0616 290/44
4,372,633 A * 2/1983 Allen ..... H01R 39/64 310/232
4,446,379 A * 5/1984 Borg ..... F03D 3/007 290/55
5,578,113 A * 11/1996 Glenn ..... B03C 3/155 261/107
6,113,351 A * 9/2000 McCallum ..... F04D 29/063 123/41.49
6,125,920 A * 10/2000 Herbert ..... F28F 1/40 165/122
6,439,850 B1 * 8/2002 McCallum ..... F04D 29/063 416/144
7,504,740 B2 * 3/2009 Murakami ..... F03D 1/0616 290/55
10,184,449 B2 * 1/2019 Wasilewski ..... F03D 3/007
10,443,564 B2 * 10/2019 Shimizu ..... F03D 3/061
2005/0139202 A1 * 6/2005 Herbert ..... F24C 15/322 126/21 A
2005/0204918 A1 * 9/2005 Brown ..... B01D 46/0023 95/273
2007/0046029 A1 * 3/2007 Murakami ..... F03D 1/0616 290/55
2007/0140836 A1 * 6/2007 Chao ..... F04D 29/282 415/119
2014/0008916 A1 * 1/2014 Shimizu ..... F03D 3/007 290/55
2014/0252770 A1 * 9/2014 Patel ..... B60K 16/00 290/50
2019/0063454 A1 * 2/2019 Chang ..... H02K 5/16

FOREIGN PATENT DOCUMENTS

JP 2010121518 A * 6/2010
JP 2013194724 A * 9/2013

* cited by examiner

HEAT-DISSIPATION FAN WITH CYLINDRICAL FAN BLADES

FIELD OF THE INVENTION

The present invention relates to the field of heat-dissipation fans, and more particularly to a heat-dissipation fan having cylindrical fan blades.

BACKGROUND OF THE INVENTION

Generally, blades on a fan wheel have specially designed air flowing angles, so that air flows through upper and lower surfaces of the blades on a rotating fan wheel at different speeds due to different lengths of the upper and the lower blade surfaces. Air at the upper blade surfaces flows at a higher speed and accordingly has smaller pressure relative to the ambient air. On the other hand, air at the lower blade surfaces flows at a lower speed and accordingly has higher pressure relative to the ambient air. The pressure difference between the upper and the lower blade surfaces causes the air at the lower blade surfaces to push against the air at the upper blade surfaces to thereby produce an ascending force. A reaction force of the ascending force forms an airflow thrust. The airflow passes the blade surfaces and turns to produce the effect of doing work and accordingly, show the features of a fan.

However, conventional fans with rotor blade/stator structure or with single rotor blade and ribbed fan frame would usually produce relatively big wideband noise and narrowband noise due to mutual influence between the wing-like shape of the fan blade structure and the fan frame. Further, conventional fans with wing-shaped blades usually produce forward airflow and therefore could not provide sufficient heat dissipation effect on heat-producing elements located behind the fans.

It is therefore tried by the inventor to develop an improved fan structure that is able to overcome the problems and disadvantages of the conventional fan structures.

SUMMARY OF THE INVENTION

A primary object of the present invention is to provide a heat-dissipation fan that includes electrical conducting units capable of supplying power to the stators of a plurality of rotary cylinders mounted on an outer surface of a rotary assembly of the heat-dissipation fan for driving the rotary cylinders to rotate about their respective centerlines.

Another object of the present invention is to provide a heat-dissipation fan that includes a plurality of rotary cylinders mounted on an axial surface of a hub of the heat-dissipation fan to serve as cylindrical fan blades of the fan. The cylindrical fan blades not only move along with the rotating hub, but also rotate about their respective centerlines to cause surrounding air to radially outward flow from the hub.

A further object of the present invention is to provide a heat-dissipation fan that includes a plurality of rotary cylinders mounted on a radial surface of a hub of the heat-dissipation fan to serve as cylindrical fan blades of the fan. The cylindrical fan blades not only move along with the rotating hub, but also rotate about their respective centerlines to cause surrounding air to axially outward flow from the hub.

A still further object of the present invention is to provide a heat-dissipation fan that includes a plurality of rotary cylinders serving as cylindrical fan blades of the fan. Airflow produced by the rotary cylinders when the latter rotate does not interact with conventionally known wing-shaped fan blades, so that the heat-dissipation fan with the cylindrical fan blades produces less noise while providing the same heat dissipation function.

A still further object of the present invention is to provide a heat-dissipation fan that includes a plurality of rotary cylinders serving as cylindrical fan blades of the fan. Airflow produced by the rotary cylinders when the latter rotate is relatively converged and can be distributed over a relatively wide area. Therefore, the produced airflow can be directly guided to a heat-producing element in a system or be directly used to carry away heat through air circulation.

A still further object of the present invention is to provide a heat-dissipation fan that includes a plurality of rotary cylinders serving as cylindrical fan blades of the fan. When the rotary cylinders rotate, they bring horizontal airflow at one lateral side of the rotary cylinders to flow toward the rotary cylinders and generate the Magnus Effect on the horizontal airflow.

A still further object of the present invention is to provide a heat-dissipation fan that includes a plurality of rotary cylinders serving as cylindrical fan blades of the fan. The rotary cylinders can rotate at different speeds to produce different amounts of thrust, so that a combined thrust of the rotary cylinders is biased to one direction. With this design, the heat-dissipation fan of the present invention can be used to dissipate heat produced by a heat source that is not located right behind the heat-dissipation fan.

A still further object of the present invention is to provide a heat-dissipation fan that includes a plurality of rotary cylinders serving as cylindrical fan blades of the fan. The rotary cylinders can be different in radius to produce different amounts of thrust, so that a combined thrust of the rotary cylinders is biased to one direction. With this design, the heat-dissipation fan of the present invention can be used to dissipate heat produced by a heat source that is not located right behind the heat-dissipation fan.

To achieve the above and other objects, the heat-dissipation fan with cylindrical fan blades according to the present invention includes a rotary assembly and a plurality of rotary cylinders. The rotary assembly includes a first rotor and a corresponding first stator for driving the first rotor to rotate; a plurality of first electrical conducting units arranged in the first rotor; and a second electrical conducting unit provided on the first stator for correspondingly contacting with the first electrical conducting units. The rotary cylinders are mounted on an outer surface of the first rotor to move along with the rotary assembly when the same is rotating. The rotary cylinders respectively include a second rotor and a second stator; the second rotor of each rotary cylinder is arranged corresponding to the second stator for driving the rotary cylinder to rotate about a centerline thereof; and the second stators are correspondingly electrically connected to the first electrical conducting units.

According to an embodiment of the present invention, the first rotor includes a hub having an outer surface and internally defining a first inner space and a second inner space located around an outer side of the first inner space. A hub shaft is provided in the first inner space and connected at an end to the hub. A first case element and a first magnetic element are disposed in the first inner space, and the first magnetic element is fitted on around an inner side of the first case element. And, the first electrical conducting units are arranged in the second inner space.

According to an embodiment of the present invention, the hub further includes an annular partitioning wall located between the first inner space and the second inner space.

According to an embodiment of the present invention, the first electrical conducting units respectively include a first suspension linking element and a second suspension linking element, which are arranged face to face. Each of the first suspension linking elements has an end connected to an inner top surface of the hub and another end connected to a first support shaft, and a first roller is movably fitted on around each of the first support shafts. Each of the second suspension linking elements has an end connected to the inner top surface of the hub and another end connected to a second support shaft, and a second roller is movably fitted on around each of the second support shafts to be located opposite to the first roller.

According to an embodiment of the present invention, the first and the second suspension linking element of each first electrical conducting unit are connected to a first and a second guide wire, respectively, and the first and the second guide wire are extended through the hub to an outer side of the hub.

According to an embodiment of the present invention, the first stator includes a first base having a center barrel formed thereon. At least one bearing is disposed in the central barrel for supporting the hub shaft therein; and a first stator winding assembly is fitted on around an outer side of the central barrel and located corresponding to the first magnetic element. The second electrical conducting unit is provided on the first base and located at an outer side of the first stator winding assembly.

According to an embodiment of the present invention, the second electrical conducting unit includes a first raised annular ring portion and a second raised annular ring portion, which are concentrically arranged. The first raised annular ring portion is connected to one of a positive and a negative electrode of an external power source, and the second raised annular ring portion is connected to the other one of the positive and the negative electrode of the external power source. The second raised annular ring portion is located around an outer side of the first raised annular ring portion; and the first and the second raised annular ring portion respectively have a fixed end connected to the first base and a free end in contact with the first electrical conducting units.

According to an embodiment of the present invention, the outer surface of the hub includes an axial surface and a radial surface, and the rotary cylinders can be mounted on the axial surface or the radial surface.

According to an embodiment of the present invention, the rotary cylinders can be angularly symmetrically or asymmetrically arranged on the outer surface of the hub.

According to an embodiment of the present invention, each of the second rotors includes a cylindrical body, an end of which internally defines an in-cylinder chamber. In each of the in-cylinder chambers, there are provided a cylinder shaft, a second case element and a second magnetic element. The cylinder shaft is connected at an end to the cylindrical body, and the second magnetic element is fitted on around an inner side of the second case element.

According to an embodiment of the present invention, each of the second stators includes a second base having a center barrel formed thereon. At least one bearing is disposed in the central barrel of the second base for supporting the cylinder shaft therein, and a second stator winding assembly is fitted on around an outer side of the central barrel of the second base and located corresponding to the second magnetic element.

According to an embodiment of the present invention, each of the second bases is provided on one side opposite to the second rotor with a fixing section for connecting to the outer surface of the first rotor.

According to an embodiment of the present invention, the cylinder bodies of the rotary cylinders are respectively provided on an outer circumferential surface with at least one radially protruded rib.

According to an embodiment of the present invention, the radially protruded ribs can include spirally extended ribs, wing-shaped ribs, waterwheel-shaped ribs, or multiple rows of circumferentially spaced short ribs.

According to an embodiment of the present invention, the rotary cylinders can be the same or different in radius.

According to an embodiment of the present invention, the rotary cylinders can rotate at the same speed or at different speeds.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
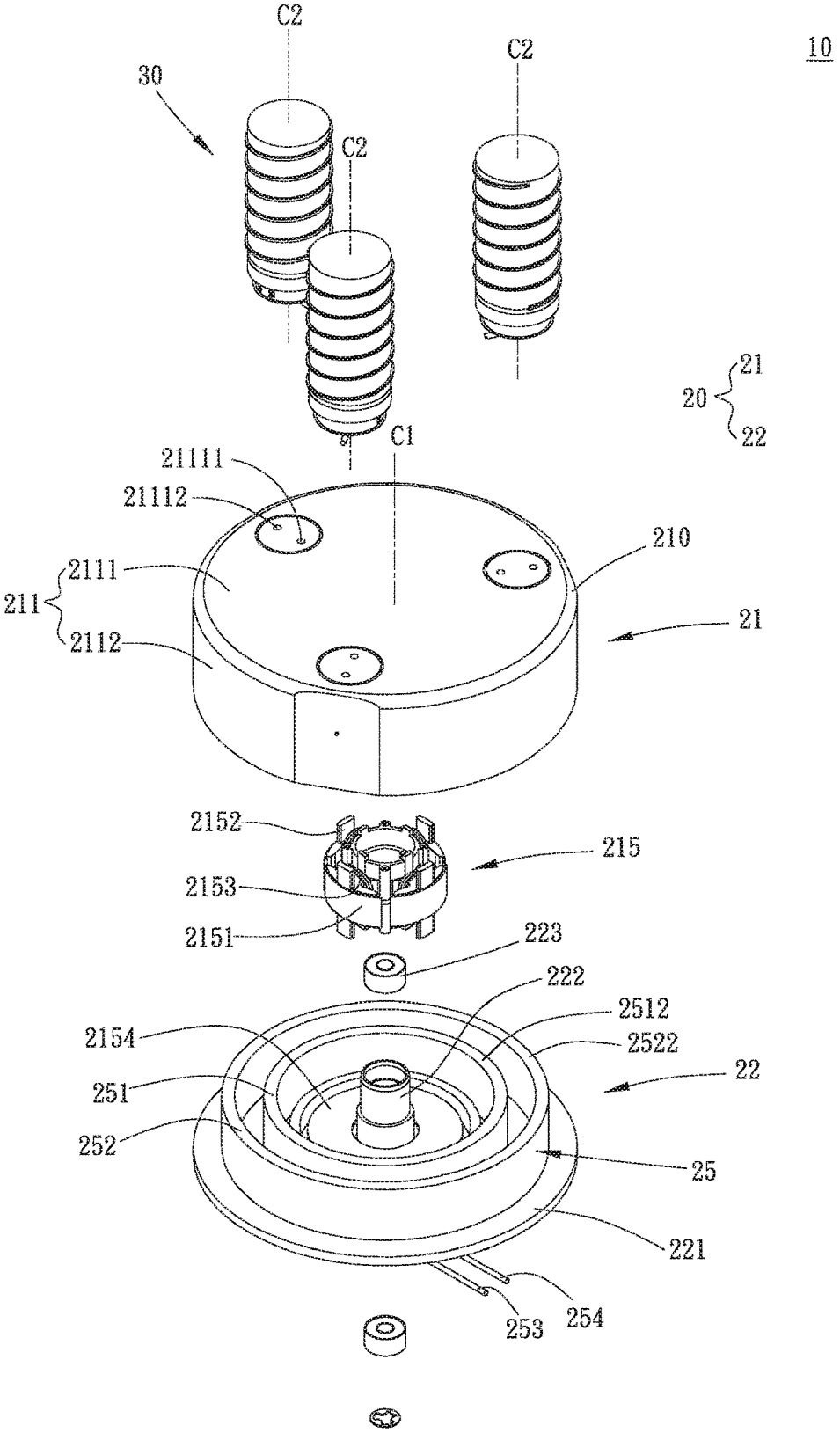
FIG. 1A is an exploded top perspective view of a heat-dissipation fan according to a first embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 1B:
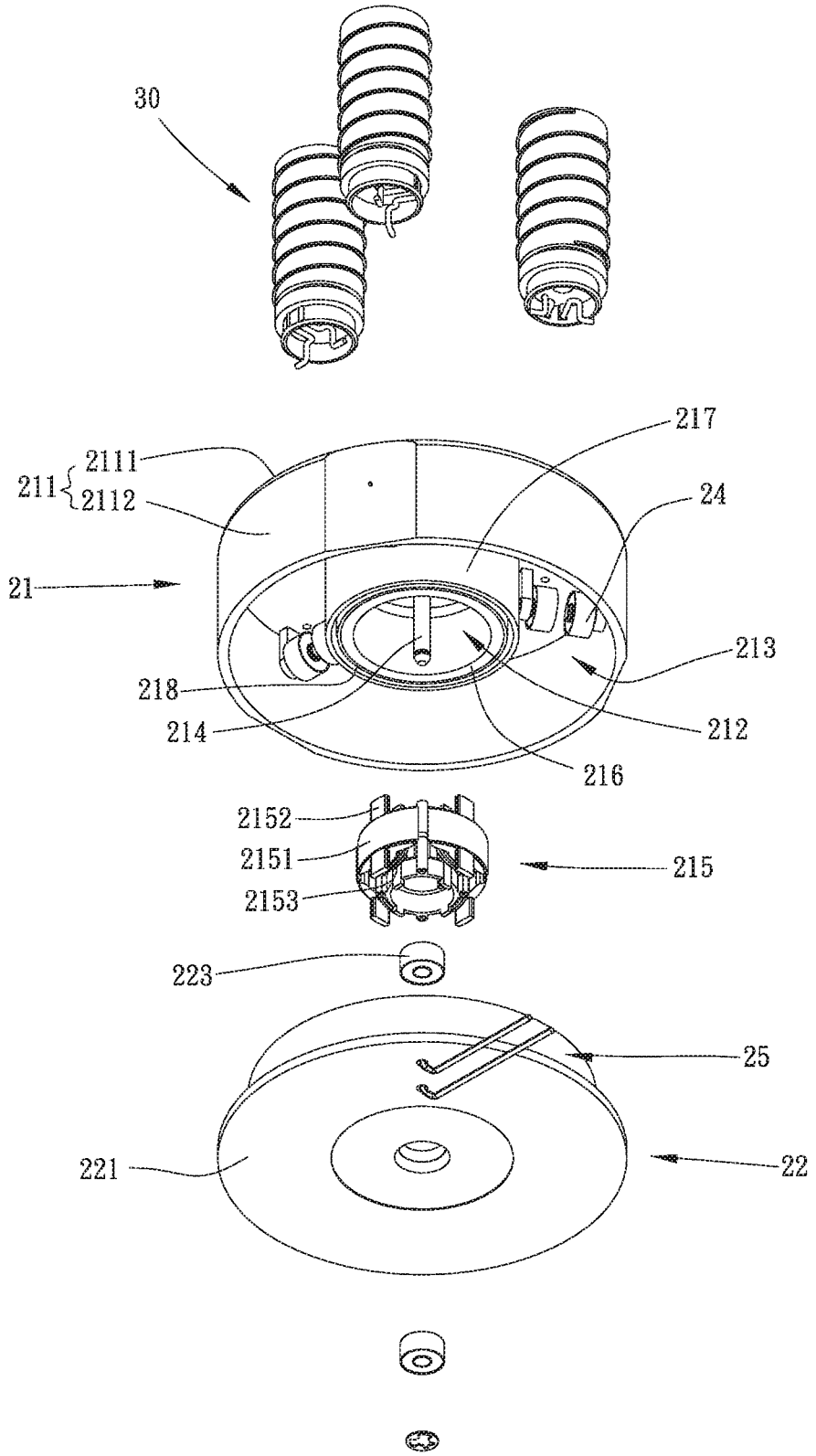
FIG. 1B is an exploded bottom perspective view of the heat-dissipation fan according to the first embodiment of the present invention.
Figure 1C:
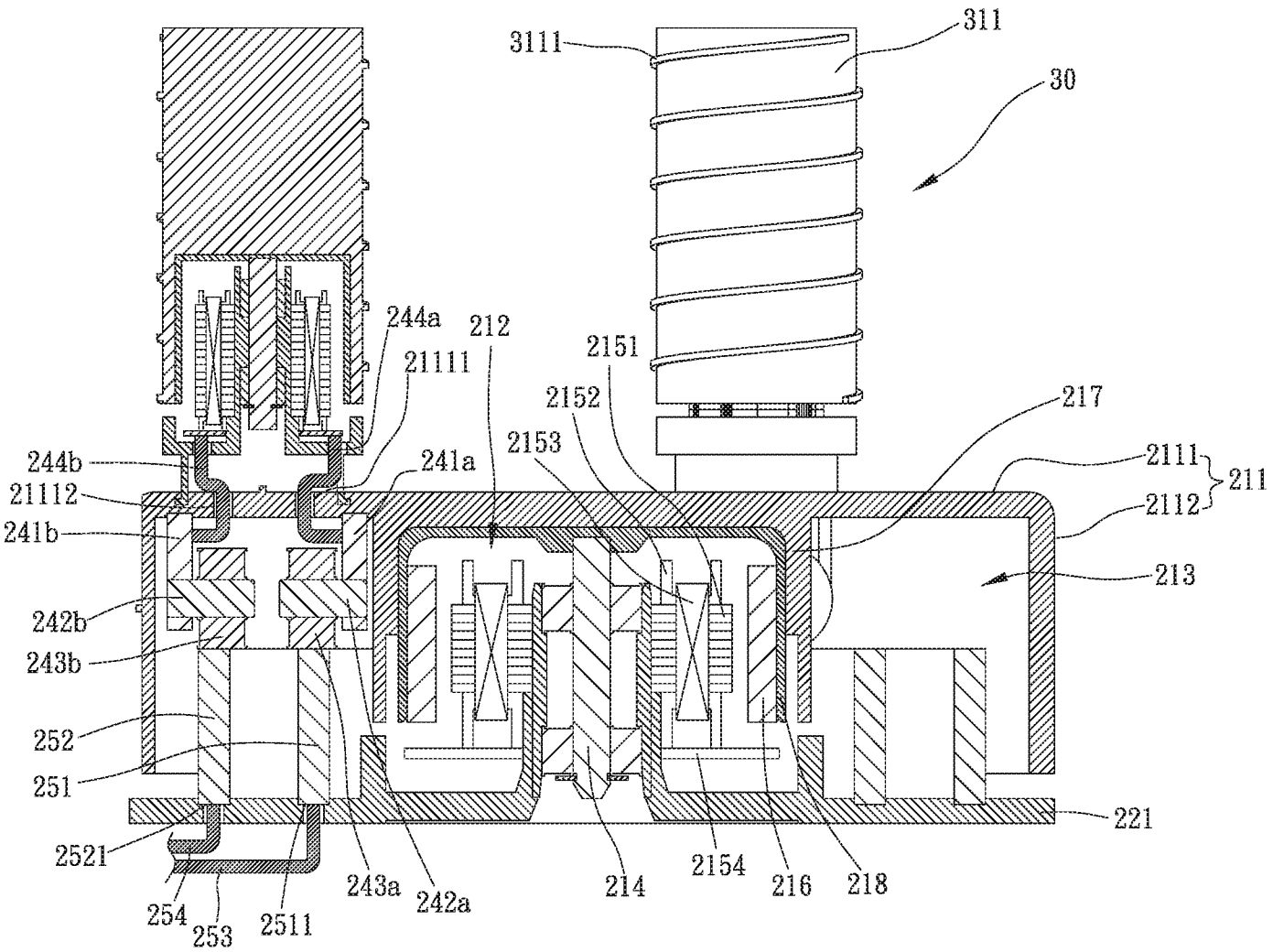
FIG. 1C is an assembled sectional view of the heat-dissipation fan according to the first embodiment of the present invention.

Please refer to FIGS. 1A and 1B, which are exploded top and bottom perspective views, respectively, of a heat-dissipation fan 10 according to a first embodiment of the present invention, and to FIG. 1C, which is an assembled sectional view of the heat-dissipation fan 10 according to the first embodiment of the present invention. As shown, the heat-dissipation fan 10 includes a rotary assembly 20 and a plurality of rotary cylinders 30.

The rotary assembly 20 includes a first rotor 21 and a corresponding first stator 22. The first rotor 21 includes a hub 210 having an outer surface 211 and internally defining a first inner space 212 and a second inner space 213. The outer surface 211 includes an axial surface 2111 and a radial surface 2112 axially downward extended from a circumferential edge of the axial surface 2111. Therefore, the radial surface 2112 is perpendicular to the axial surface 2111. In the present invention, the axial surface 2111 is a top surface of the hub 210 and the radial surface 2112 is a side surface of the hub 210.

The first inner space 212 and the second inner space 213 are concentrically arranged with the second inner space 213 located around an outer side of the first inner space 212; and an annular partitioning wall 217 is located between the first and the second inner space 212, 213. In the first inner space 212, there is provided a hub shaft 214, which is connected to the hub 210. A first case element 218, such as an iron case, and a first magnetic element 216, such as a magnet, are disposed in the first inner space 212 with the first magnetic element 216 fitted on around an inner side of the first case element 218. A plurality of first electrical conducting units 24 is arranged in the second inner space 213 corresponding to the rotary cylinders 30. In the illustrated first embodiment, there are shown three first electrical conducting units 24.

The first stator 22 includes a first base 221 having a central barrel 222 formed thereon. At least one bearing 223 is disposed in the central barrel 222 for supporting the hub shaft 214 therein. The hub shaft 214 inserted through the bearings 223 disposed in the central barrel 222 is held in place by a retaining ring, such that the first rotor 21 is disposed on the first stator 22. A first stator winding assembly 215 is fitted on around an outer side of the central barrel 222 and is located corresponding to the first magnetic element 216 in the first inner space 212. When the first stator winding assembly 215 is supplied with an electric current, it interacts with the first magnetic element 216 to generate electromagnetic induction, which drives the first rotor 21 of the rotary assembly 20 to rotate. The first stator winding assembly 215 includes a laminated silicon steel sheet assembly 2151, a set of insulation bobbins 2152 separately located at an upper and a lower side of the silicon steel sheet assembly 2151, a winding assembly 2153 wound around the set of insulation bobbins 2152, and a first circuit board 2154 (see FIG. 1C) located below the insulation bobbins 2152 and electrically connected to the winding assembly 2153. The first circuit board 2154 is connected to an external power source (not shown) to get and supply electric power to the first stator winding assembly 215 for the latter to function. A second electrical conducting unit 25 is provided on the first base 221 and located at an outer side of the first stator winding assembly 215. The position of the second electrical conducting unit 25 is axially or vertically corresponding to the first electrical conducting units 24 arranged in the second inner space 213 of the first rotor 21. The first electrical conducting units 24 and the second electrical conducting unit 25 are made of an electrically conducting material, such as a metal material; and the hub 210 and the first base 221 are made of an electrically insulating material, such as a plastic material.

Each of the first electrical conducting units 24 includes a first suspension linking element 241*a* and a second suspension linking element 241*b*, which are arranged face to face. Each of the first suspension linking elements 241*a* is connected at an end to an inner top surface of the hub 210 and at another end to a first support shaft 242*a*. A first roller 243*a* is movably fitted on around each of the first support shafts 242*a*. Each of the second suspension linking elements 241*b* is connected at an end to the inner top surface of the hub 210 and at another end to a second support shaft 242*b*. A second roller 243*b* is movably fitted on around each of the second support shafts 242*b* to be located opposite to the first roller 243*a*. The first suspension linking element 241*a* and the second suspension linking element 241*b* of each first electrical conducting unit 24 are further connected to a first guide wire 244*a* and a second guide wire 244*b*, respectively. The hub 210 is provided on its top 2111 at positions corresponding to the rotary cylinders 30 with two bores 21111, 21112 each, which extend through the hub 210. The first guide wire 244*a* and the second guide wire 244*b* corresponding to each of the electrical conducting units 24 pass through the corresponding bores 21111, 21112, respectively, to an outer side of the hub 210 to connect to the rotary cylinders 30.

The second electrical conducting unit 25 includes a first raised annular ring portion 251 and a second raised annular ring portion 252, which are concentrically arranged and are connected to a positive and a negative electrode, respectively, of an external power source (not shown) via a positive lead 253 and a negative lead 254, respectively. It is understood the above electrical connection is only illustrative. In other operable embodiments, the first and the second raised annular ring portion 251, 252 can be connected to a negative and a positive electrode of an external power source via the negative and the positive lead 254, 253, respectively. The second raised annular ring portion 252 is located around an outer side of the first raised annular ring portion 251. The first and the second raised annular ring portion 251, 252 respectively have a fixed end 2511, 2521 connected to the first base 221, and a free end 2512, 2522 axially extended forward to contact with the first rollers 243*a* and the second rollers 243*b* the first electrical conducting units 24, respectively.

More specifically, when the hub 210 rotates, the first electrical conducting units 24 are brought to move along with the hub 210. At this point, the first and the second rollers 243*a*, 243*b* roll on the free end 2512 of the first raised annular ring portion 251 and the free end 2522 of the second raised annular ring portion 252, respectively. With these arrangements, the external positive power source is supplied to the first rollers 243*a* via the first raised annular ring portion 251. From the first rollers 243*a*, the positive power source is further supplied to the rotary cylinders 30 via the first support shafts 242*a*, the first suspension linking elements 241*a* and the first guide wires 244*a*. Meanwhile, the external negative power source is supplied to the second rollers 243*b* via the second raised annular ring portion 252. From the second rollers 243*b*, the negative power source is further supplied to the rotary cylinders 30 via the second support shafts 242*b*, the second suspension linking elements 241*b* and the second guide wires 244*b*.

The rotary cylinders 30 are located on the outer surface 211 of the first rotor 21. In the first embodiment, the rotary cylinders 30 are vertically mounted on the axial surface 2111 of the hub 210, such that centerlines c2 of the rotary cylinders 30 are parallel to a centerline c1 of the hub 210. The rotary cylinders 30 are brought by the first rotor 21 of the rotary assembly 20 to revolve about the centerline c1 of the hub 210.

Figure 2A:
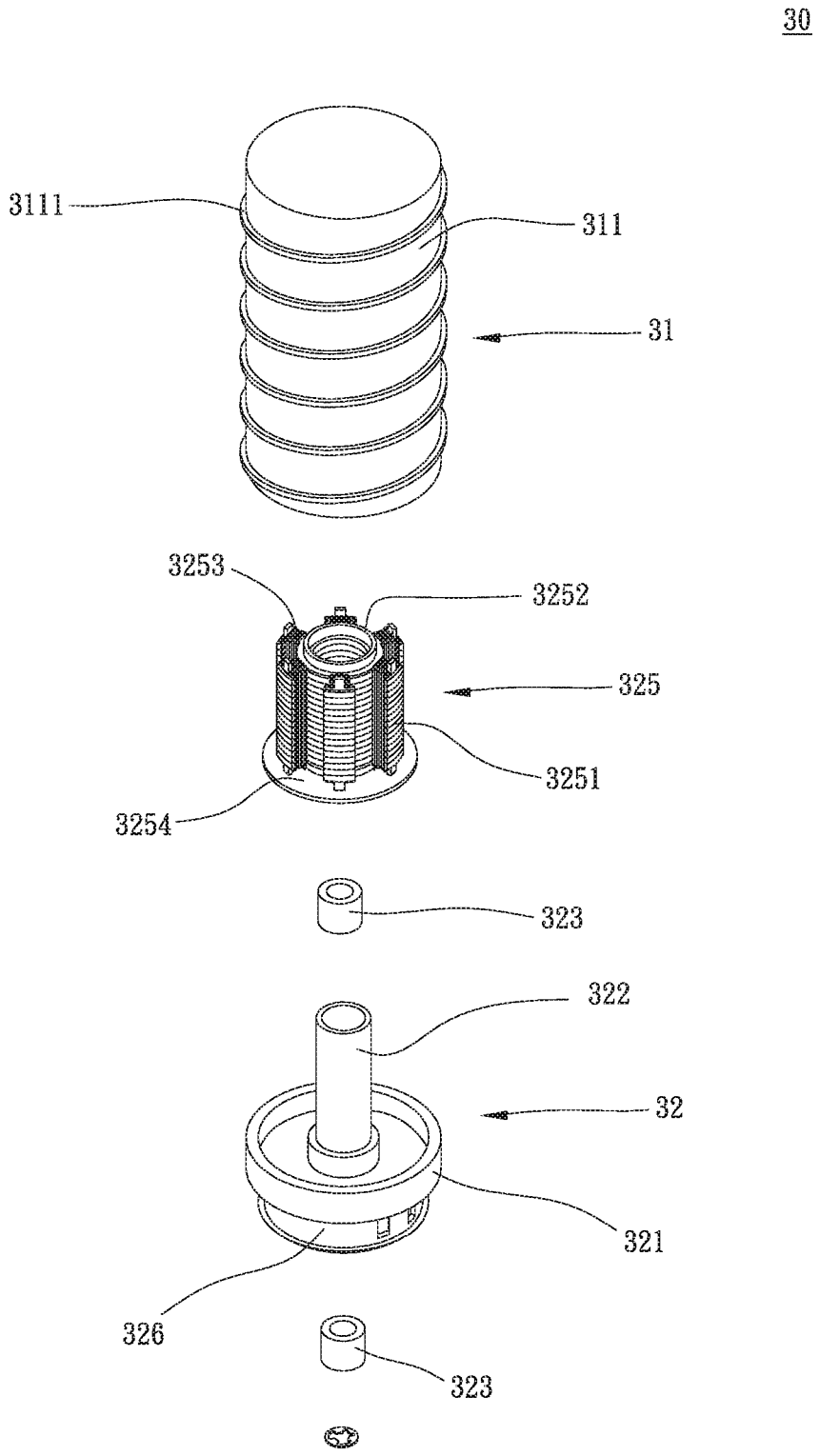
FIG. 2A is an exploded perspective view of a rotary cylinder serving as a cylindrical fan blade of the heat-dissipation fan of the present invention.
Figure 2B:
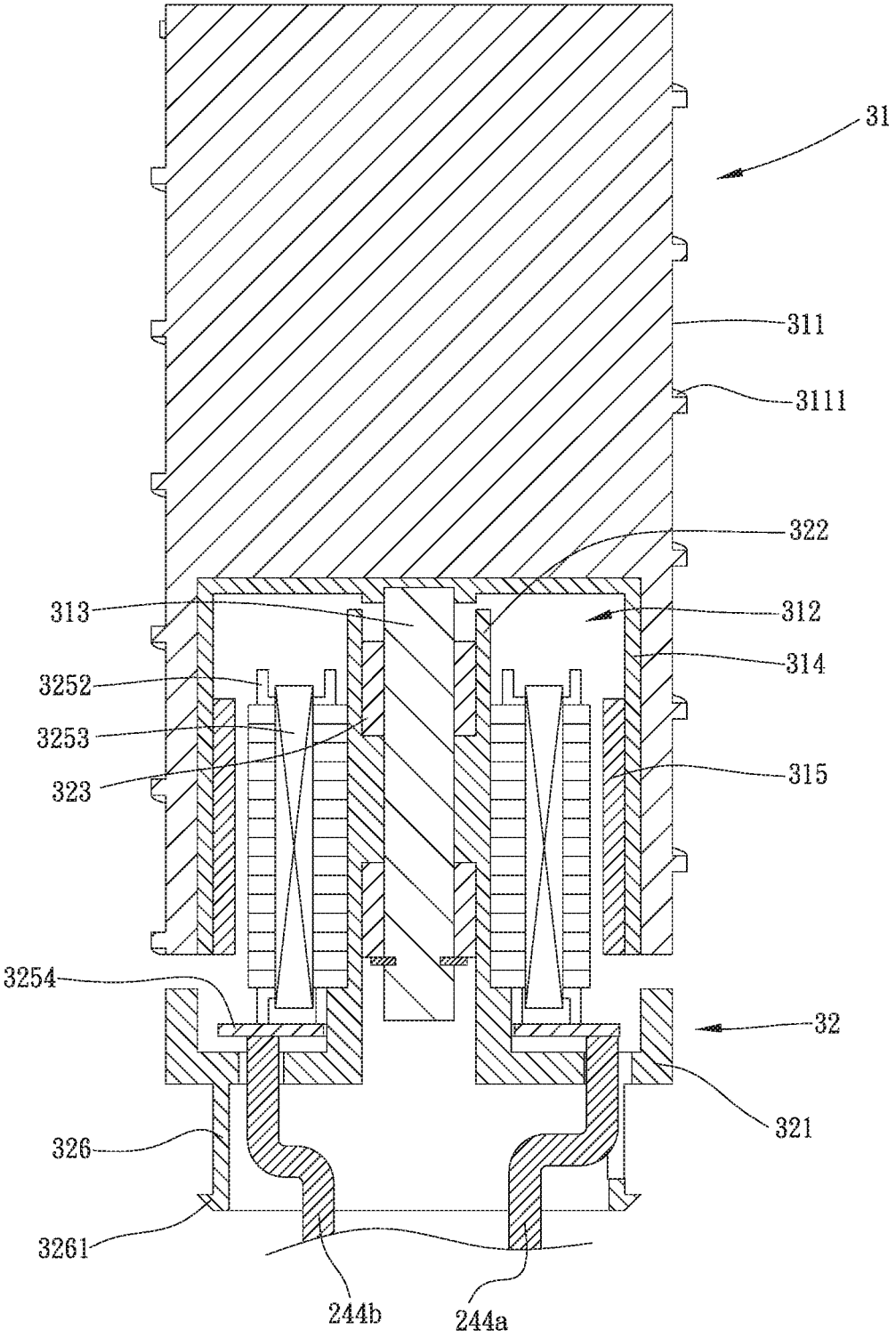
FIG. 2B is an assembled sectional view of the rotary cylinder of FIG. 2A.

Please refer to FIG. 2A, which is an exploded perspective view of the rotary cylinder 30 of the present invention; and to FIG. 2B, which is an assembled sectional view of the rotary cylinder 30. As shown in FIGS. 2A and 2B, each of the rotary cylinders 30 includes a second rotor 31 and a corresponding second stator 32. The second rotor 31 drives the rotary cylinder 30 to rotate about its centerline c2.

Each of the second rotors 31 includes a cylindrical body 311, an end of which internally defines an in-cylinder chamber 312. In each of the in-cylinder chambers 312, there are a cylinder shaft 313 connected at an end to the cylindrical body 311, a second case element 314, and a second magnetic element 315. The second magnetic element 315 is fitted on around an inner side of the second case element 314. each of the cylindrical bodies 311 is provided on an outer circumferential surface thereof with at least one radially protruded rib 3111. In the illustrated first embodiment, the radially protruded rib 3111 is spirally extended around the outer circumferential surface of the cylindrical body 311.

Each of the second stators 32 includes a second base 321 having a central barrel 322 formed thereon. At least one bearing 232 is disposed in the central barrel 322 for supporting the cylinder shaft 313 therein. The cylinder shaft 313 inserted through the bearings 323 disposed in the central barrel 322 is held in place by a retaining ring, such that the second rotor 31 is disposed on the second stator 32. A second stator winding assembly 325 is fitted on around an outer side of the central barrel 322 and is located corresponding to the second magnetic element 315 in the in-cylinder chamber 312. When the second stator winding assembly 325 is supplied with an electric current, it interacts with the second magnetic element 315 to generate electromagnetic induction, which drives the second rotor 31 of the rotary cylinder 30 to rotate.

Each of the second stator winding assemblies 325 includes a laminated silicon steel sheet assembly 3251, a set of insulation bobbins 3252 separately located at an upper and a lower side of the silicon steel sheet assembly 3251, a winding assembly 3253 wound around the set of insulation bobbins 3252, and a second circuit board 3254 located below the insulation bobbins 3252 and electrically connected to the winding assembly 3253.

Please refer to FIG. 1C again. The first guide wires 244*a* and the second guide wires 244*b* connected at respective one end to the first and the second suspension linking elements 241*a*, 241*b* of the first electrical conducting units 24 are further connected at respective another end to the second circuit boards 3254 of the second stator winding assemblies 325 of the rotary cylinders 30, such that the external positive power source and the external negative power source are transmitted to the second circuit boards 3254 via the first and the second guide wires 244*a*, 244*b* for supplying electric power to the second stator winding assemblies 325 for the latter to function.

Also, as shown in FIGS. 2A and 2B, each of the second bases 321 is provided with a fixing section 326 for connecting to a predetermined position on the axial surface 2111 of the hub 210 of the first rotor 21. Each of the fixing sections 326 has a lower end forming a retaining hook portion 3261 for hooking to the hub 210. In some other operable embodiments of the present invention, the fixing section 326 can be fixedly connected to the hub 210 by way of riveting, bonding or screw tightening.

Figure 3A:
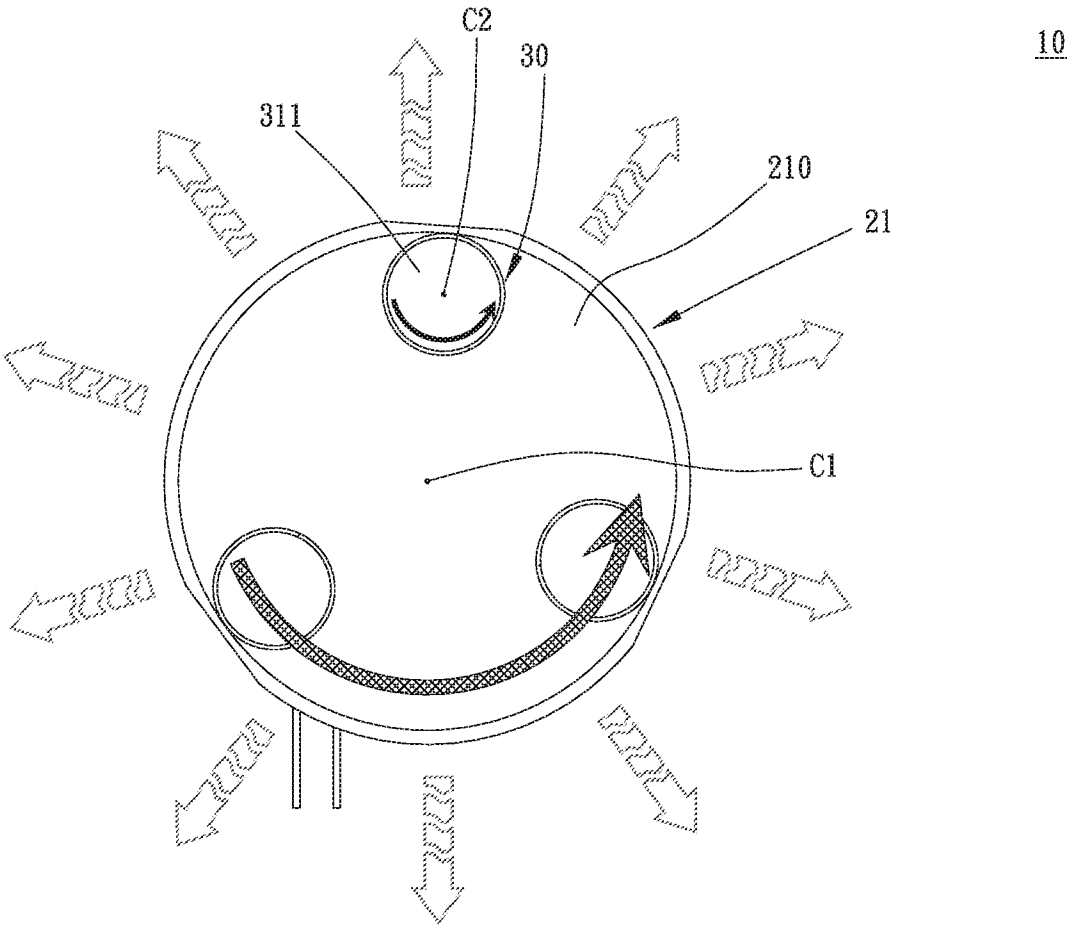
FIG. 3A is a top view showing the movements of the heat-dissipation fan according to the first embodiment of the present invention in an actuated state.
Figure 3B:
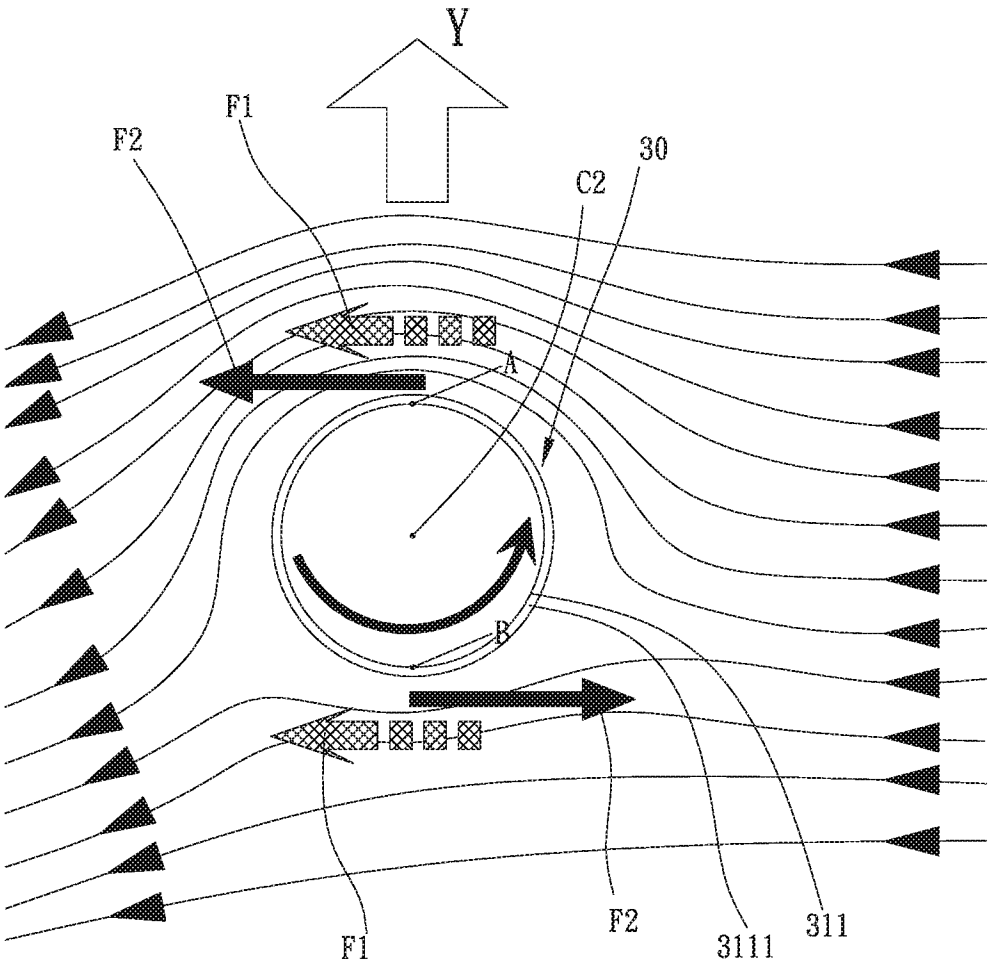
FIG. 3B shows the rotary cylinder of the heat-dissipation fan according to the first embodiment of the present invention in a rotating state.

Please refer to FIGS. 3A and 3B. When the hub 210 of the first rotor 21 rotates, the rotary cylinders 30 mounted on the hub 210 are brought to revolve around the centerline c1 of the hub 210. Meanwhile, the second stator 32 and the second rotor 31 of each of the rotary cylinders 30 interact with each other, so that the cylindrical body 311 of the second rotor 31 is driven to rotate about its centerline c2, which brings horizontal airflow at one lateral side of the rotary cylinder 30 to flow toward the rotary cylinder 30 (in FIG. 3B, it is shown the horizontal airflow flows from a right side toward a left side of the rotary cylinder 30 when viewing in front of the drawing) and generates the Magnus Effect on the horizontal airflow. That is, there is an additive effect on a total speed of the horizontal airflow speed F1 and the tangential airflow speed F2 at one side A of the rotary cylinder 30 (which is the side above the rotary cylinder 30 in FIG. 3B), at where the horizontal airflow and the tangential airflow have the same flowing direction. In other words, the horizontal airflow flowing through the side A of the rotary cylinder 30 has increased flowing speed and reduced pressure according to the Bernoulli's Principle. On the other hand, there is a subtractive effect on a total speed of the horizontal airflow speed F1 and the tangential airflow speed F2 at the other opposite side B of the rotary cylinder 30 (which is the side below the rotary cylinder 30 in FIG. 3B), at where the horizontal airflow and the tangential airflow have two opposite flowing directions. In other words, the horizontal airflow flowing through the side B of the rotary cylinder 30 has decreased flowing speed and increased pressure according to the Bernoulli's Principle. Due to a pressure difference between the horizontal airflow flowing through the side A and the side B, the horizontal airflow having higher pressure pushes against the horizontal airflow having lower pressure to produce a horizontal thrust Y, which is normal to the direction of the horizontal airflow. Under this action, the heat-dissipation fan 10 produces centrifugal airflow. That is, air surrounding each of the rotary cylinders 30 is brought to flow radially outward from the heat-dissipation fan 10.

Figure 4A:
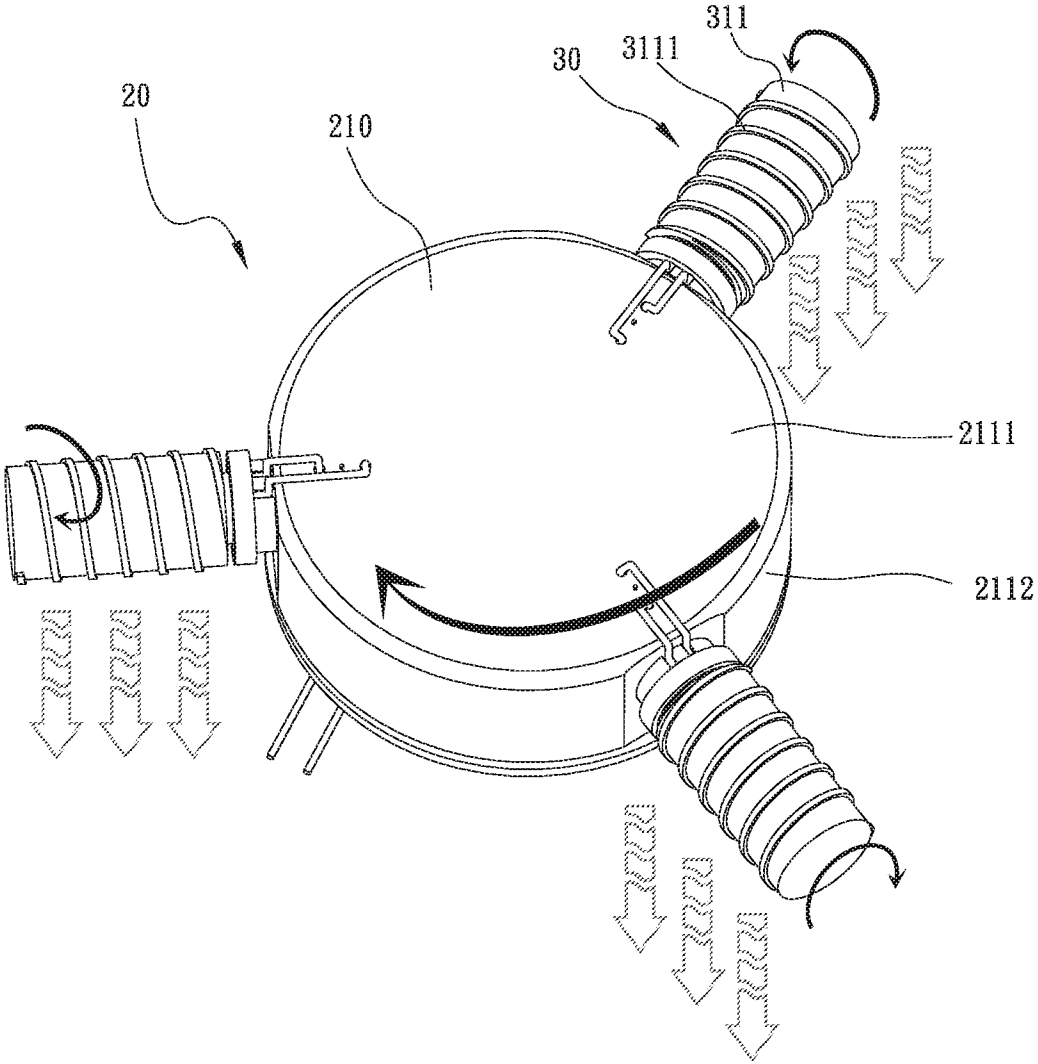
FIG. 4A is a perspective view showing the movements of a heat-dissipation fan according to a second embodiment of the present invention in an actuated state.
Figure 4B:
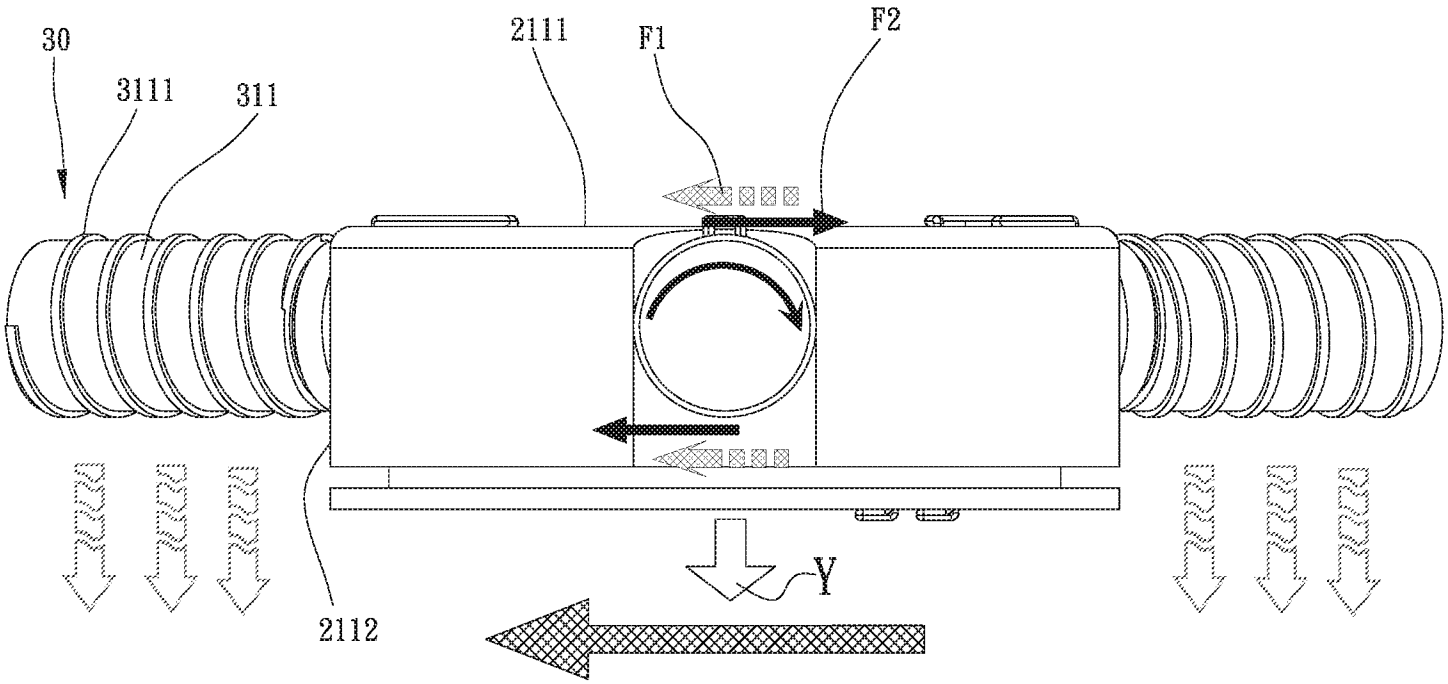
FIG. 4B is a front view of the heat-dissipation fan according to the second embodiment of the present invention in an actuated state.

In FIGS. 4A and 4B, there is shown a heat-dissipation fan according to a second embodiment of the present invention. In the second embodiment, the rotary cylinders 30 are mounted on the radial surface 2112 of the hub 210 of the rotary assembly 20 to respectively extend in a radially outward direction. When the hub 210 of the rotary assembly 20 and the rotary cylinders 30 mounted on the hub 210 rotate at the same time, there is a subtractive effect on a total speed of the horizontal airflow speed F1 and the tangential airflow speed F2 at one side above each of the rotary cylinders 30, at where the horizontal airflow and the tangential airflow have two opposite flowing directions. In other words, the horizontal airflow flowing through the upper side of the rotary cylinders 30 has decreased flowing speed and increased pressure according to the Bernoulli's Principle.

On the other hand, there is an additive effect on a total speed of the horizontal airflow speed F1 and the tangential airflow speed F2 at one side below each of the rotary cylinders 30, at where the horizontal airflow and the tangential airflow have the same flowing direction. In other words, the horizontal airflow flowing through the lower side of the rotary cylinders 30 has increased flowing speed and reduced pressure according to the Bernoulli's Principle. Due to a pressure difference between the horizontal airflow flowing through the upper side and the lower side of the rotary cylinders 30, the horizontal airflow having higher pressure pushes against the horizontal airflow having lower pressure to produce a horizontal thrust Y, which is normal to the direction of the horizontal airflow. Under this action, the heat-dissipation fan 10 produces axial airflow. That is, air surrounding each of the rotary cylinders 30 is brought to flow axially outward from the heat-dissipation fan 10.

According to an operable embodiment, the rotary cylinders 30 are caused to rotate at the same speed. According to another operable embodiment, the rotary cylinders 30 are caused to rotate at different speeds and accordingly, produce different amounts of thrust. It is possible to adjust the rotational speeds of the rotary cylinders 30, so that a combined thrust of the rotary cylinders 30 is biased to one direction. With this design, the heat-dissipation fan 10 of the present invention can be used to dissipate heat produced by a heat source that is not located right behind the heat-dissipation fan 10.

Figure 5A:
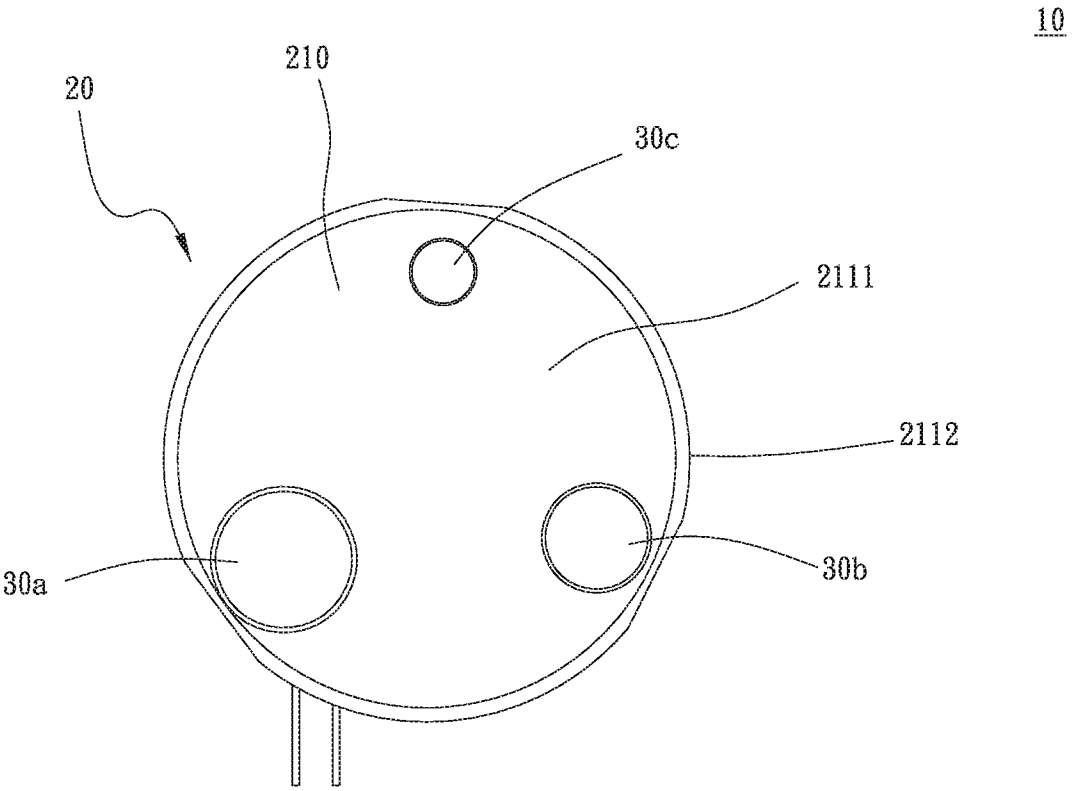
FIGS. 5A and 5B show a third and a fourth embodiment, respectively, of the heat-dissipation fan of the present invention.
Figure 5B:
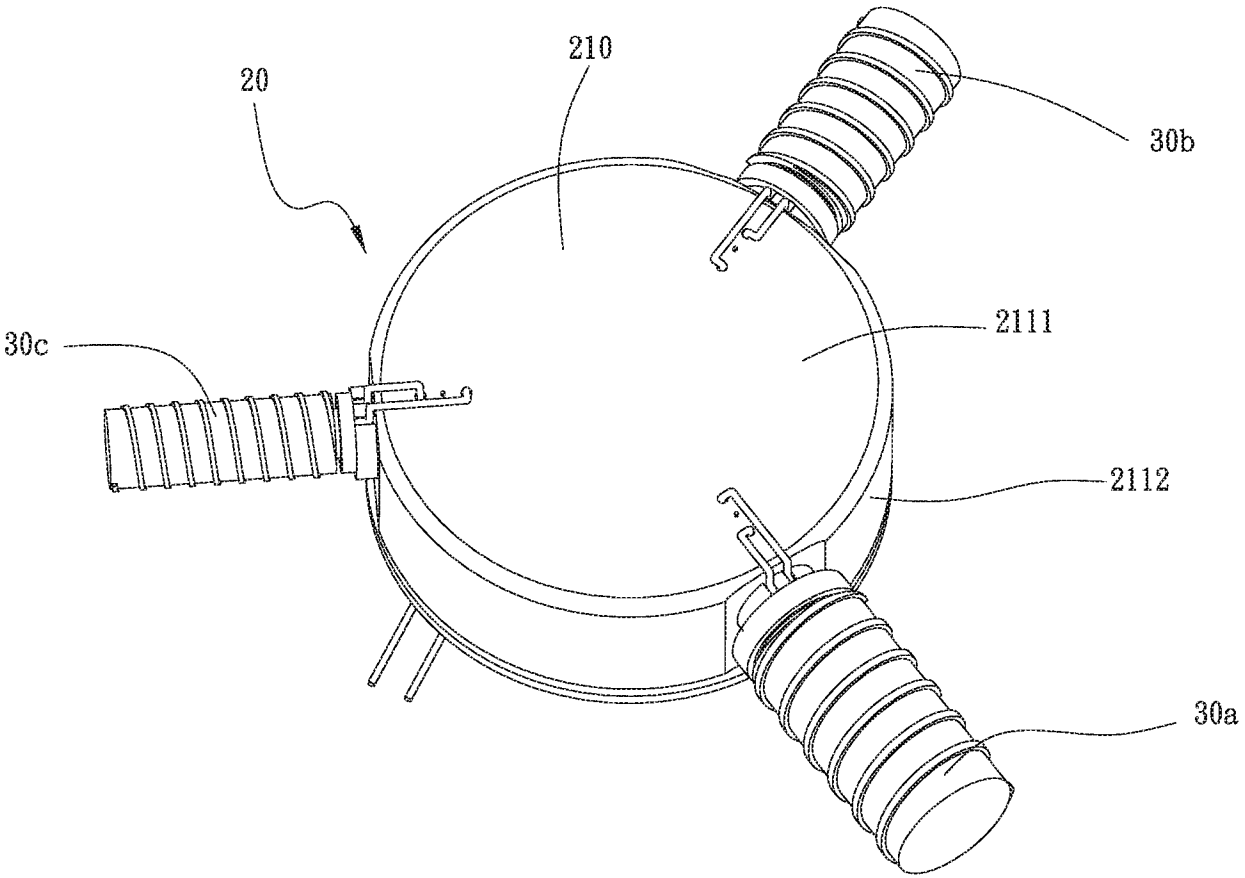

Please refer to FIGS. 5A and 5B, in which a third and a fourth embodiment, respectively, of the heat-dissipation fan of the present invention are shown. In the first and second embodiments, the rotary cylinders 30 have the same radius. However, the rotary cylinders 30 in the third embodiment shown in FIG. 5A are mounted on the axial surface 2111 of the hub 210 and are different in radius; and the rotary cylinders 30 in the fourth embodiment shown in FIG. 5B are mounted on the radial surface 2112 of the hub 210 and are different in radius. For instance, in each of the third and fourth embodiments, there are three rotary cylinders 30*a*, 30*b*, 30*c* mounted on the hub 210. The rotary cylinder 30*a* has a radius larger than that of the rotary cylinder 30*b*, and the rotary cylinder 30*b* has a radius larger than that of the rotary cylinder 30*c*. With these arrangements, the rotary cylinders 30*a*, 30*b*, 30*c* can produce different amounts of airflow and accordingly, different amounts of thrust. In the third and the fourth embodiment, it is possible to adjust the amount of airflow produced by each of the rotary cylinders 30, so that a combined thrust of the rotary cylinders 30 is biased to one direction. With this design, the heat-dissipation fan 10 of the present invention can be used to dissipate heat produced by a heat source that is not located right behind the heat-dissipation fan 10.

Figure 6C:
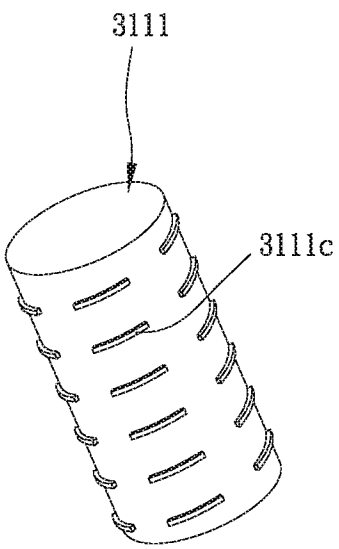
FIGS. 6A, 6B and 6C show some different configurations for the rotary cylinder of the heat-dissipation fan according to the present invention.
Figure 6B:
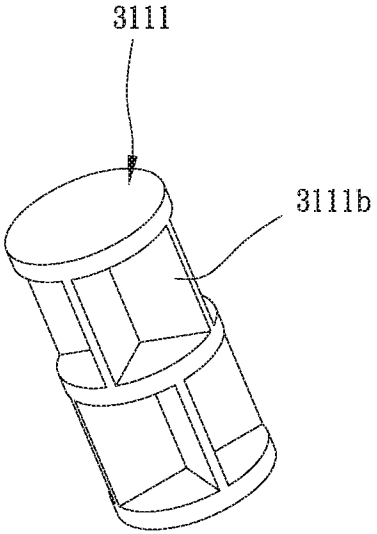
Figure 6A:
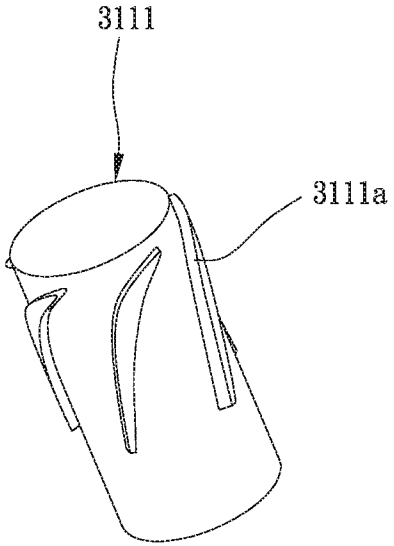

While the rotary cylinders 30 shown in the first to the fourth embodiment are provided on their outer circumferential surfaces with spirally extended, radially protruded ribs 3111, the radially protruded ribs 3111 in other operable embodiments can be differently designed. For example, in FIG. 6A, there is shown wing-shaped radially protruded ribs 3111*a*; in FIG. 6B, there is shown waterwheel-shaped radially protruded ribs 3111*b*; and in FIG. 6C, there is shown multiple rows of circumferentially spaced radially protruded short ribs 3111*c*.

Figure 7A:
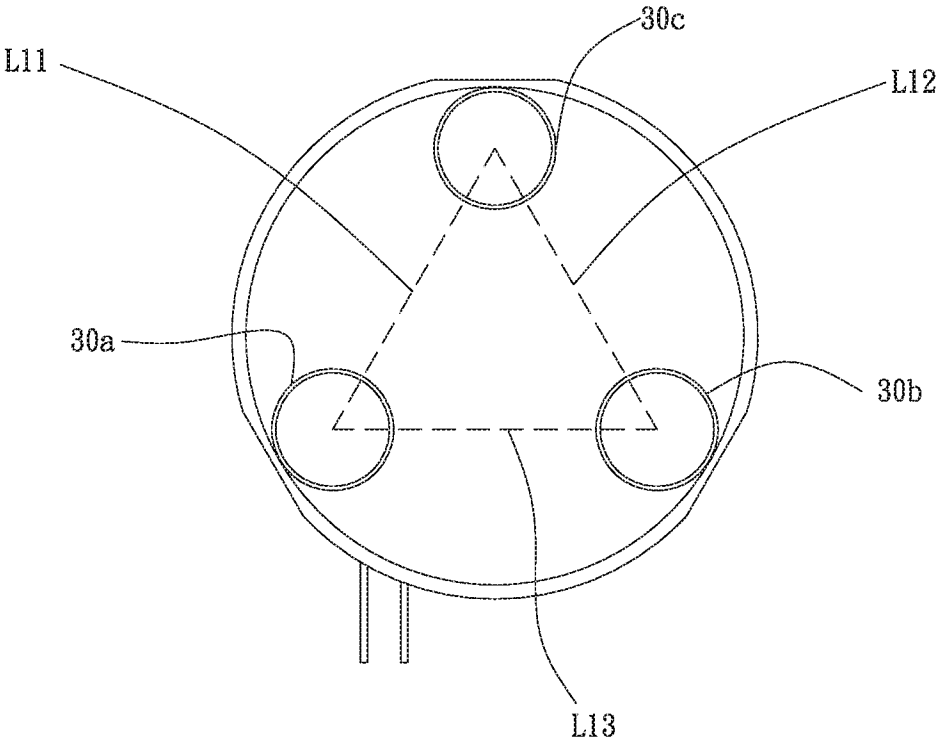
FIG. 7A shows a plurality of rotary cylinders is angularly symmetrically arranged on an axial surface of a hub of the heat-dissipation fan of the present invention.

According to an operable embodiment as shown in FIG. 7A, the rotary cylinders 30*a*, 30*b*, 30*c* are perpendicularly mounted and angularly symmetrically arranged on the axial surface 2111 of the hub 210, such that any two adjacent ones of the rotary cylinders 30*a*, 30*b* and 30*c* are spaced by a linear distance the same as that between any other two adjacent rotary cylinders. More specifically, as shown in FIG. 7A, the linear distance L11 between the rotary cylinders 30*a*, 30*c* is the same as the linear distance L12 between the rotary cylinders 30*b*, 30*c* and the linear distance L13 between the rotary cylinders 30*a*, 30*b*.

Figure 7B:
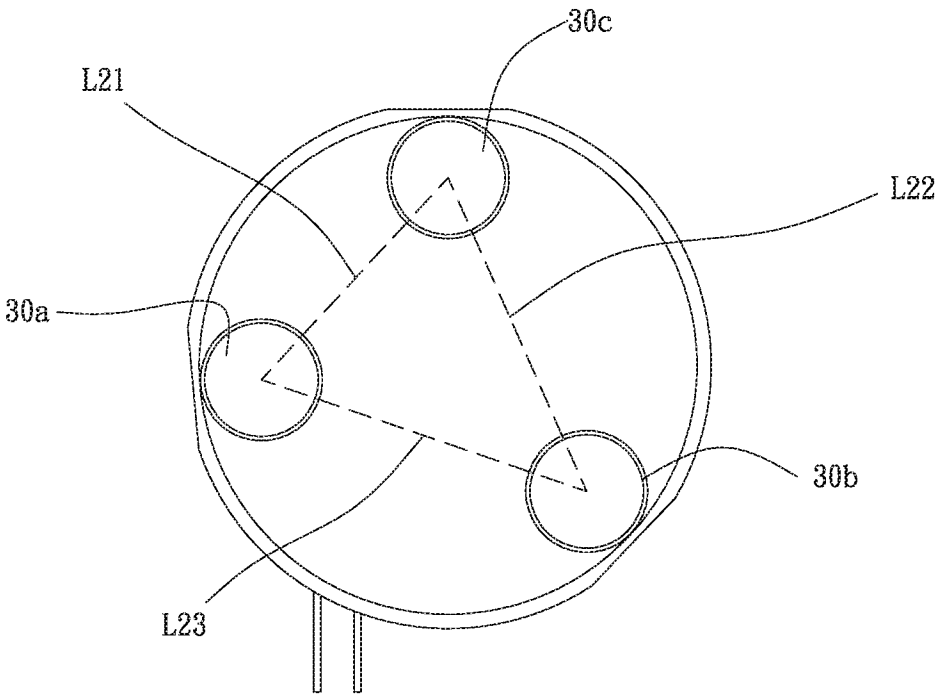
FIG. 7B shows a plurality of rotary cylinders is angularly asymmetrically arranged on an axial surface of a hub of the heat-dissipation fan of the present invention.

According to another operable embodiment as shown in FIG. 7B, the rotary cylinders 30*a*, 30*b*, 30*c* are perpendicularly mounted and angularly asymmetrically arranged on the axial surface 2111 of the hub 210, such that any two adjacent ones of the rotary cylinders 30*a*, 30*b* and 30*c* are spaced by a linear distance different from that between any other two adjacent rotary cylinders. More specifically, as shown in FIG. 7B, the linear distance L21 between the rotary cylinders 30*a*, 30*c*, the linear distance L22 between the rotary cylinders 30*b*, 30*c* and the linear distance L23 between the rotary cylinders 30*a*, 30*b* are different from one another.

Figure 8A:
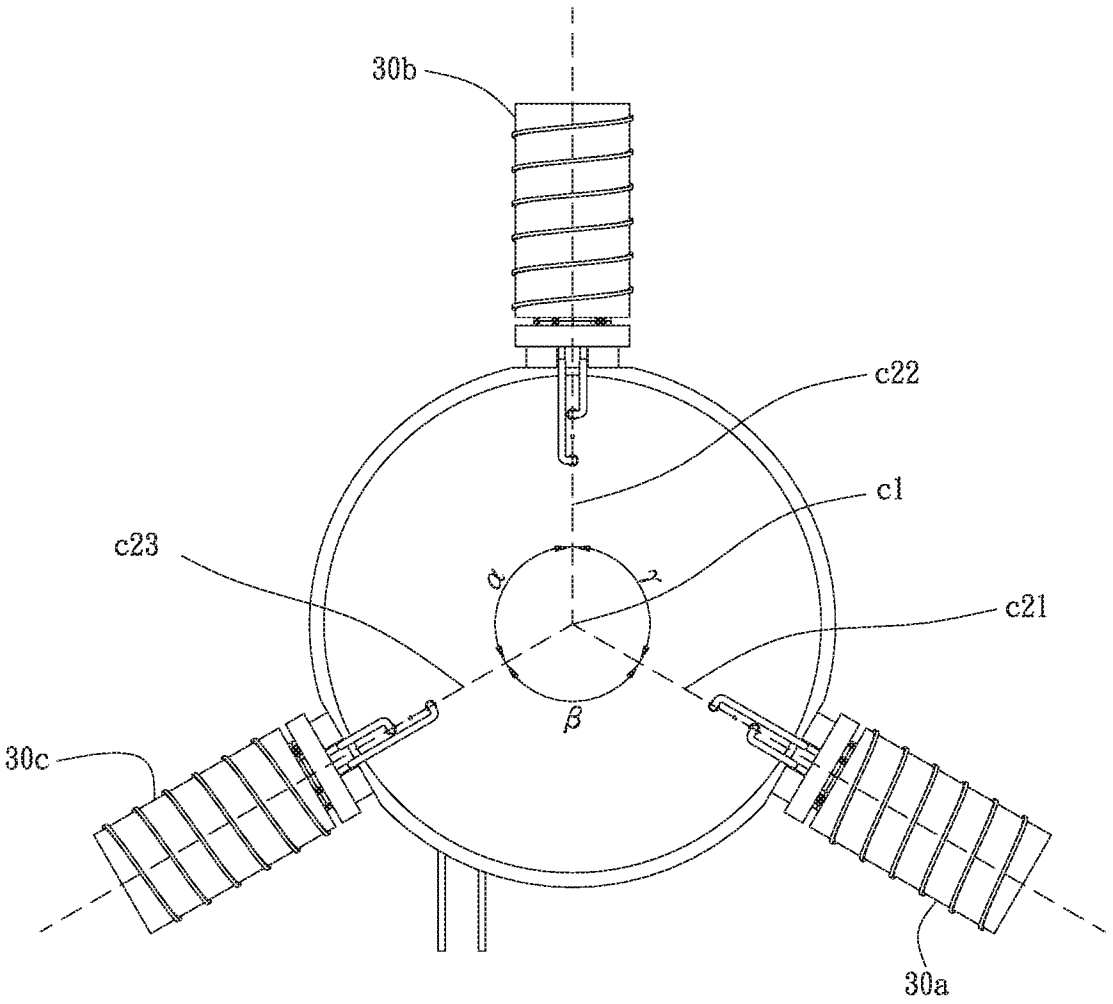
FIG. 8A shows a plurality of rotary cylinders is angularly symmetrically arranged on a radial surface of a hub of the heat-dissipation fan of the present invention.

According to an operable embodiment as shown in FIG. 8A, the rotary cylinders 30*a*, 30*b*, 30*c* are perpendicularly mounted and angularly symmetrically arranged on the radial surface 2112 of the hub 210 of the rotary assembly 20, such that an included angle between any two adjacent ones of the rotary cylinders 30*a*, 30*b* and 30*c* is the same as that between any other two adjacent rotary cylinders. More specifically, as shown in FIG. 8A, the rotary cylinders 30*a*, 30*b*, 30*c* respectively have an axis c21, c22, c23 that extend to the centerline c1 of the hub 210. The included angle γ defined between the axes c21, c22 of the rotary cylinders 30*a*, 30*b* is the same as the included angle α defined between the axes c22, c23 of the rotary cylinders 30*b*, 30*c* and the included angle β defined between the axes c21, c23 of the rotary cylinders 30*a*, 30*c*.

Figure 8B:
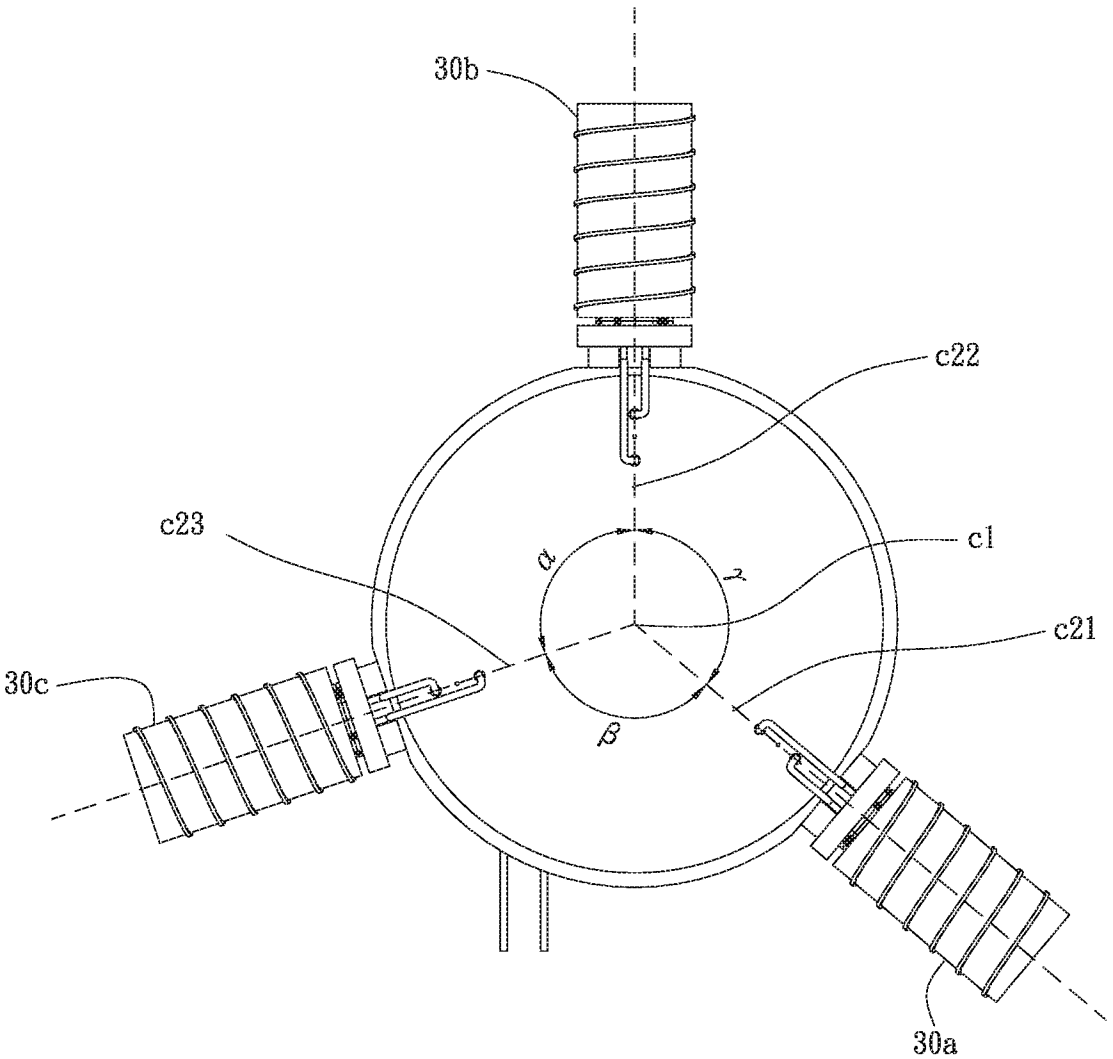
FIG. 8B shows a plurality of rotary cylinders is angularly asymmetrically arranged on a radial surface of a hub of the heat-dissipation fan of the present invention.

According to another operable embodiment as shown in FIG. 8B, the rotary cylinders 30*a*, 30*b*, 30*c* are perpendicularly mounted and angularly asymmetrically arranged on the radial surface 2112 of the hub 210 of the rotary assembly 20, such that the included angle γ defined between the axes c21, c22 of the rotary cylinders 30*a*, 30*b*, the included angle α defined between the axes c22, c23 of the rotary cylinders 30*b*, 30*c* and the included angle β defined between the axes c21, c23 of the rotary cylinders 30*a*, 30*c* are different from one another.

In conclusion, the heat-dissipation fan according to the present invention has the following advantages:

(1) When the rotary assembly 20 of the heat-dissipation fan 10 rotates, the first electrical conducting units 24 and the second electrical conducting unit 25 supply power to the second stators 32 of the rotary cylinders 30 mounted on the outer surface 211 of the hub 210 for driving the rotary cylinders 30 to rotate about their centerlines without being interfered by any power cord.

(2) The rotary cylinders 30 mounted on the axial surface 2111 of the hub 210 can produce radial airflow; and the rotary cylinders 30 mounted on the radial surface 2112 of the hub 210 can produce axial airflow.

(3) The airflow produced by the rotary cylinders 30 does not interact with any conventional wing-shaped fan blade and accordingly, produces less noise in the process of dissipating heat.

(4) The airflow produced by the rotary cylinders 30 is relatively converged and can be distributed over a relatively wide area. Therefore, the produced airflow can be directly guided to heat-producing elements in a system or be directly used to carry away heat through air circulation.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A heat-dissipation fan with cylindrical fan blades, comprising:

a rotary assembly including a first rotor and a corresponding first stator for driving the first rotor to rotate; a plurality of first electrical conducting units arranged in the first rotor; and a second electrical conducting unit provided on the first stator for correspondingly contacting with the first electrical conducting units; and a plurality of rotary cylinders being mounted on an outer surface of the first rotor to move along with the rotary assembly when the same is rotating; the rotary cylinders respectively including a second rotor and a second stator, the second rotor in each rotary cylinder being arranged corresponding to the second stator for driving the rotary cylinder to rotate about a centerline thereof; and the second stators being correspondingly electrically connected to the first electrical conducting units;

wherein the first electrical conducting units respectively include a first suspension linking element and a second suspension linking element, which are arranged face to face;

wherein each of the first suspension linking elements having an end connected to an inner top surface of the hub and another end connected to a first support shaft, and a first roller being movably fitted on around each of the first support shafts; and wherein each of the second suspension linking elements having an end connected to the inner top surface of the hub and another end connected to a second support shaft, and a second roller being movably fitted on around each of the second support shafts to be located opposite to the first roller.

2. The heat-dissipation fan with cylindrical fan blades as claimed in claim 1, wherein the first rotor includes a hub having an outer surface and internally defining a first inner space and a second inner space located around an outer side of the first inner space; a hub shaft being provided in the first inner space and connected at an end to the hub; a first case element and a first magnetic element being disposed in the first inner space, and the first magnetic element being fitted on around an inner side of the first case element; and the first electrical conducting units being arranged in the second inner space.

3. The heat-dissipation fan with cylindrical fan blades as claimed in claim 2, wherein the hub further includes an annular partitioning wall located between the first inner space and the second inner space.

4. The heat-dissipation fan with cylindrical fan blades as claimed in claim 1, wherein the first and the second suspension linking element of each first electrical conducting unit are connected to a first and a second guide wire, respectively, and the first and the second guide wires being extended through the hub to an outer side of the hub.

5. The heat-dissipation fan with cylindrical fan blades as claimed in claim 2, wherein the first stator includes a first base having a center barrel formed thereon; at least one bearing disposed in the central barrel for supporting the hub shaft therein, a first stator winding assembly fitted on an outer side of the central barrel and aligned with the first magnetic element, and the second electrical conducting unit being provided on the first base and located at an outer side of the first stator winding assembly.

6. The heat-dissipation fan with cylindrical fan blades as claimed in claim 5, wherein the second electrical conducting unit includes a first raised annular ring portion and a second raised annular ring portion, which are concentrically arranged; the first raised annular ring portion being connected to one of a positive and a negative electrode of an external power source, and the second raised annular ring portion being connected to the other one of the positive and the negative electrode of the external power source; the second raised annular ring portion being located around an outer side of the first raised annular ring portion; and the first and the second raised annular ring portion respectively having a fixed end connected to the first base and a free end in contact with the first electrical conducting units.

7. The heat-dissipation fan with cylindrical fan blades as claimed in claim 2, wherein the outer surface of the hub includes an axial surface and a radial surface, and the rotary cylinders being mounted on any one of the axial surface and the radial surface.

8. The heat-dissipation fan with cylindrical fan blades as claimed in claim 7, wherein the rotary cylinders are angularly symmetrically or asymmetrically arranged on the outer surface of the hub.

9. The heat-dissipation fan with cylindrical fan blades as claimed in claim 1, wherein each of the second rotors includes a cylindrical body with an internally defined in-cylinder chamber; in each of the in-cylinder chambers, there being provided a cylinder shaft, a second case element and a second magnetic element; the cylinder shaft being connected at an end to the cylindrical body, and the second magnetic element being fitted on around an inner side of the second case element.

10. The heat-dissipation fan with cylindrical fan blades as claimed in claim 9 wherein each of the second stators includes a second base having a center barrel formed thereon; at least one bearing being disposed in the central barrel of the second base for supporting the cylinder shaft therein, and a second stator winding assembly being fitted on around an outer side of the central barrel of the second base and located next to the second magnetic element.

11. The heat-dissipation fan with cylindrical fan blades as claimed in claim 10, wherein each of the second bases is provided with a retaining hook for connecting to the outer surface of the first rotor.

12. The heat-dissipation fan with cylindrical fan blades as claimed in claim 9, wherein outer circumferential surfaces of the cylinder bodies of the rotary cylinders are respectively provided with at least one radially protruded rib.

13. The heat-dissipation fan with cylindrical fan blades as claimed in claim 12, wherein the radially protruded ribs include spirally extended ribs, wing-shaped ribs, water-wheel-shaped ribs, or multiple rows of circumferentially spaced short ribs.

14. The heat-dissipation fan with cylindrical fan blades as claimed in claim 1, wherein the rotary cylinders are different in radius.

15. The heat-dissipation fan with cylindrical fan blades as claimed in claim 1, wherein the rotary cylinders rotate at different speeds.

* * * * *